US009312114B2

(12) United States Patent
Hock et al.

(10) Patent No.: US 9,312,114 B2
(45) Date of Patent: Apr. 12, 2016

(54) ION EJECTION FROM A QUADRUPOLE ION TRAP

(71) Applicant: Thermo Fisher Scientific (Bremen) GmbH, Bremen (DE)

(72) Inventors: Christian Albrecht Hock, Bremen (DE); Dmitry Grinfeld, Bremen (DE); Richard Heming, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/717,369

(22) Filed: May 20, 2015

(65) Prior Publication Data

US 2015/0340220 A1 Nov. 26, 2015

(30) Foreign Application Priority Data

May 21, 2014 (GB) ..... 1409074.0

(51) Int. Cl.

| | |
|---|---|
| ***H01J 49/00*** | (2006.01) |
| ***H01J 49/06*** | (2006.01) |
| ***H01J 49/04*** | (2006.01) |
| ***H01J 49/40*** | (2006.01) |
| ***H01J 49/42*** | (2006.01) |
| ***H01J 49/28*** | (2006.01) |

(52) U.S. Cl.

CPC ..... *H01J 49/063* (2013.01); *H01J 49/0481* (2013.01); *H01J 49/282* (2013.01); *H01J 49/40* (2013.01); *H01J 49/424* (2013.01); *H01J 49/4225* (2013.01)

(58) Field of Classification Search

CPC ..... H01J 49/00; H01J 49/02; H01J 49/0027; H01J 49/0095; H01J 49/06; H01J 49/061; H01J 49/062; H01J 49/063; H01J 49/067

USPC ..... 250/281, 282, 283, 286, 293, 290

See application file for complete search history.

(56) References Cited

U.S. PATENT DOCUMENTS

| | | | | |
|---|---|---|---|---|
| 3,767,914 | A * | 10/1973 | Mueller | H01J 49/42 250/287 |
| 5,569,917 | A | 10/1996 | Buttrill, Jr. et al. | |
| 5,763,878 | A | 6/1998 | Franzen | |
| 6,380,666 | B1 | 4/2002 | Kawato | |
| 6,483,244 | B1 | 11/2002 | Kawato et al. | |
| 7,250,600 | B2 | 7/2007 | Yamaguchi et al. | |
| 7,256,397 | B2 | 8/2007 | Kawato et al. | |
| 7,498,571 | B2 | 3/2009 | Makarov et al. | |

(Continued)

FOREIGN PATENT DOCUMENTS

| | | | |
|---|---|---|---|
| EP | 1302973 | B1 | 9/2012 |
| GB | 2507611 | A | 5/2014 |

*Primary Examiner* — Nicole Ippolito
*Assistant Examiner* — Jason McCormack
(74) *Attorney, Agent, or Firm* — David A. Schell

(57) ABSTRACT

A method of ejecting ions to be analyzed from a quadrupole ion trap in which a trapping field is created by one or more RF voltages applied to one or more electrodes of the trap, the method comprising the steps of cooling the ions to be analyzed within the quadrupole ion trap until the ions are thermalized, reducing the amplitude of one or more RF voltages applied to the quadrupole ion trap and applying the reduced amplitude RF voltages for one half cycle after the one or more RF voltages have reached a zero crossing point, turning off the RF voltages applied to the quadrupole ion trap, and ejecting the ions to be analyzed from the quadrupole ion trap.

30 Claims, 7 Drawing Sheets

(56) References Cited

U.S. PATENT DOCUMENTS

| | | | | |
|---|---|---|---|---|
| 7,897,916 | B2 | 3/2011 | Sudakov et al. | |
| 8,030,613 | B2 | 10/2011 | Makarov et al. | |
| 2005/0045816 | A1* | 3/2005 | Yamaguchi | H01J 49/424 250/286 |
| 2008/0217527 | A1* | 9/2008 | Wang | H01J 49/426 250/282 |
| 2010/0072362 | A1 | 3/2010 | Giles et al. | |
| 2012/0138788 | A1 | 6/2012 | Taniguchi | |
| 2014/0008533 | A1* | 1/2014 | Brekenfeld | H01J 49/424 250/288 |

* cited by examiner

ION EJECTION FROM A QUADRUPOLE ION TRAP

FIELD OF THE INVENTION

This invention relates to the field of ion ejectors for providing pulsed ion packets to time-of-flight mass analysers, ion trap mass analysers or Fourier Transform mass analysers. In particular the invention relates to ion ejectors which comprise quadrupole ion traps.

BACKGROUND OF THE INVENTION

Quadrupole ion traps operated with radio-frequency (RF) potentials (also known as Paul traps) are used in mass spectrometry for accumulating ions and for ejecting pulsed packets of ions into a mass analyser. Suitable mass analysers include time-of-flight (TOF), electrostatic trap (EST), and Fourier Transform mass spectrometers (FT-MS). TOF mass spectrometers include linear TOF, reflectron TOF and multi-reflection TOF. EST mass spectrometers include orbital traps such as Kingdon traps, a type of which is marketed as ORBITRAP™ by the applicant and which utilises image current ion detection and Fourier Transform signal processing. FT-MS mass spectrometers include ORBITRAP™ mass analysers and ion cyclotron resonance mass analysers.

In many cases, the quadrupole ion trap must eject a packet of ions within a short time duration, the packet containing ions of a wide range of mass-to-charge ratios (m/z). The pulse duration should be uniformly small over the whole range of m/z.

In quadrupole ion traps the ions are confined by RF fields which are induced by the RF potentials which are applied to one or more trap electrodes. In 3D quadrupole ion traps one or more RF potentials are applied to one or more of a ring electrode and two end cap electrodes. Typically in linear quadrupole ion traps, four generally parallel rod electrodes have two opposite polarity RF waveforms applied, one to each pair of opposing rods.

Quadrupole ion traps for ejection to a mass spectrometer usually operate with a gas introduced into the trap volume, and collisions between ions and the gas molecules cause the ions to lose energy progressively with each collision and thereby cool to approximately the gas temperature, which may be room temperature, or lower in cryogenic traps, and the ions are said to be thermalized. This serves to reduce the spread in velocities in the direction of ejection, and hence reduce the range of times at which ions of the same m/z reach the mass spectrometer, and in some cases its detector. This range of times directly limits the mass resolving power of a TOF mass spectrometer, for example, and hence should be as small as possible.

Once the ions have undergone enough collisions with the gas to cool all the ions within the desired mass range sufficiently, the ions are ejected from the quadrupole ion trap. In the 3D quadrupole ion trap, ions are ejected through a small aperture in one of the end caps. In the linear ion trap, ions are ejected either from one end of the linear trap generally along its axis (axial ejection), or orthogonal to the trap axis through one of the gaps between the rod electrodes, or through a slot formed in one of the rod electrodes (orthogonal ejection). Orthogonal ejection is preferable because the ion packet is then smaller in the direction of ejection. To eject the ions, either an ejection potential is applied across the trap in addition to the RF trapping potentials, or the RF trapping potentials are turned off and an ejection potential is applied.

In some cases one or more RF trapping potentials are turned off when they reach a zero crossing point. As used herein in relation to applied RF potentials, the term "zero crossing point" refers to a time at which the (time-varying) RF potential is momentarily at zero potential, either during passage from a positive potential to a negative potential, or during passage from a negative potential to a positive potential. Where two RF potentials are applied to an ion trap, those potentials are typically at opposite phases from each other. Hence when one RF potential reaches a zero crossing point, so does the other RF potential, but one RF potential is passing from a positive potential to a negative potential and the other RF potential is passing from a negative potential to a positive potential.

Ejected ions are introduced into a mass analyser and travel within the analyser along an analyser flight path. Ions of different m/z travel the analyser flight path either traversing a distance to a detector in different times, or undergoing oscillatory motion within the analyser at different frequencies. The analyser flight path may be linear, comprise linear portions, or may be curved or comprise curved portions. In order to travel along the analyser flight path the ions must be injected into the analyser along an injection trajectory. As used herein the term "analyser injection trajectory" refers to the injection trajectory which ions must follow in order to enter the analyser so that they subsequently travel along the analyser flight path. It will be understood by the skilled person that the analyser injection trajectory and the analyser flight path are finite volumes of space within which ions travel though they may be represented as lines.

U.S. Pat. No. 5,569,917 describes the simultaneous application of opposite polarity extraction potentials of similar magnitude to the two end caps of a 3D quadrupole ion trap in order to eject ions in a collimated beam. The beam was then post-accelerated for use in a TOF mass spectrometer.

U.S. Pat. No. 6,380,666 describes the simultaneous application of opposite polarity extraction potentials of different magnitudes to the two end caps of a 3D quadrupole ion trap, without post-acceleration.

U.S. Pat. No. 6,483,244 describes a 3D quadrupole ion trap and an electronic arrangement with switches in which the RF trapping voltage is turned rapidly to zero and extraction voltages are applied to the end cap electrodes at nearly the same time as the RF potential is terminated. In this arrangement the RF trapping voltage may be terminated at any chosen part of the RF cycle by operation of the switches. On terminating the RF trapping potential, the RF trapping potential actually present on the ring electrode of the ion trap approaches zero with a time constant determined by the capacitance between the electrodes of the trap and the internal resistance of the switches. This time constant is small enough to prevent the ions escaping from the ion trapping region. However the problem of abrupt stopping the RF voltage in the moment of its maximal span still remains unresolved because of considerable capacitance of the trap's electrodes.

U.S. Pat. No. 7,250,600 describes a 3D quadrupole ion trap in which the RF trapping potential is terminated in a way which minimises the spatial spread of ions within the trap at the time the ejection potential is applied. The ions within the trap move under the influence of the RF field within the trap, moving from a larger volume of space within the trap to a smaller volume as a function of the phase of the RF potential applied to the trap ring electrode. The RF trapping potential is terminated at a time when ions of a given polarity are converging or have converged to the smaller volume and the ions are ejected from the trap from a smaller volume within the trap thereby minimising the variation in starting positions of the ejected ions. The RF trapping potential is terminated at a zero crossing point, i.e. at a time at which the time-varying potential is momentarily at zero potential. Due to the various electronic components connected to the trap, the RF potential could not, in this arrangement, be terminated instantaneously, and a time delay between the attempted termination of the RF potential and the application of the ejection pulse was provided. It is explained that during this time period the ions do not experience a trapping effect and may move freely and disperse, and having a large time delay is not recommended.

U.S. Pat. No. 7,256,397 describes a 3D quadrupole ion trap in which the RF trapping voltage applied to the ring electrode is terminated at a predetermined phase and an ejection potential is applied across the end cap electrodes after a predetermined time period, the predetermined phase and the predetermined time period being chosen such that the actual potential on the ring electrode is the same after the predetermined time period irrespective of the amplitude of the RF voltage when it is terminated. By this means a time at which the ejection potential is applied may be found so that the actual voltage on the ring electrode is the same regardless of the m/z range trapped (which is determined by the amplitude of the RF trapping potential applied) and the time delay during which no quadrupole field exists within the trap and in which ions may disperse is minimised.

US patent application 2014/0008533 describes a 3D quadrupole ion trap in which a single phase RF trapping voltage is applied to both end cap electrodes, and is switched down shortly before a zero crossing point at which the ion cloud spatially contracts. A DC extraction potential is then applied to at least one of the two end cap electrodes.

U.S. Pat. No. 5,763,878 describes a linear multipole ion trap with orthogonal ejection of ions. The multipole may be of various forms including hexapole, quadrupole and distorted quadrupole arrangements. For ion ejection the RF trapping potential is terminated at a zero crossing point and ejection potentials are applied to various electrodes to create an approximately uniform field within a portion of the trap.

U.S. Pat. Nos. 7,498,571 and 8,030,613 describe an electrical circuit including a switched shunt to short out a secondary winding of the RF voltage driver to rapidly switch off the RF trapping potential. A DC ejection potential may then be applied with or without a time delay for axial or orthogonal ejection from a linear quadrupole trap. The RF trapping potential is rapidly switched off at a zero crossing point.

When an extraction field $E_x$ is applied to an ion trap, there is necessarily a variation in potential induced within the trap volume, there being a potential gradient in the direction of ejection for ions of a chosen polarity. Accordingly, ions at different spatial locations within the trap which are at different locations on the potential gradient will undergo differing potential changes on travelling to the entrance of the mass analyser. The spatial spread $\delta x$ in the direction of the axis of extraction, x, within the ion trap, produces a kinetic energy spread when the ions arrive at the mass analyser, $\delta K = q \cdot E_x \cdot \delta x$, where q is the charge on the ions. As described above, prior art methods of ion extraction have given consideration to reducing the spatial spread of ions within the trap at the moment of ejection, notably as described in U.S. Pat. No. 7,250,600, and this reduces the kinetic energy spread of the ions which arrive at the mass analyser.

However, a temporal or time-of-flight focus may be formed, where ions which were farthest from the mass analyser at the moment the ion ejection field was applied undergo the largest potential drop and thus have the highest kinetic energy, subsequently overtaking ions which were closest to the mass analyser at the moment the ion ejection field was applied. A temporal focus may be formed to coincide with a desired location within a mass spectrometer, and may be imaged to another location, such as a detector plane in a TOF mass spectrometer, for example. Where a temporal focus is formed, the temporal spread of ions at the temporal focus is not dominated by the initial spatial spread $\delta x$ in the direction of the axis of extraction, x, within the ion trap, but instead is predominantly determined by the initial velocity spread in the direction of the axis of extraction $\delta v_x$ of the ions in the trap.

Typically ions have a spread in velocities ranging from $-\delta v_x/2$ to $+\delta v_x/2$ at the moment the extraction field is applied. If a first ion has a velocity $-\delta v_x/2$ it travels away from the mass spectrometer for a period of time, it takes a time $\delta t = m \cdot \delta v_x / q \cdot E_x$ to travel away, turn around and come back to its initial location. Meanwhile a second ion starting from the same position with velocity $+\delta v_x/2$ has progressed towards the mass spectrometer. The time difference $\delta t$ between these two ions cannot be compensated for in practice as the ions possess no characteristics by which they may be distinguished from one another, being of the same energy and originating from the same point, and at represents the dominant temporal spread of the ions at a temporal focus. The time difference $\delta t$ is called the turn-around time (for obvious reasons). This temporal spread directly limits the mass resolving power which may be obtained by the mass spectrometer, according to $t_{TOF}/2.\delta t$, for a TOF mass spectrometer, for example, where $t_{TOF}$ is the total time of flight from the ion starting point within the ejector to the detector of the spectrometer.

Hence where a temporal focus is formed, it is desirable not to extract ions in a way which minimises their spatial spread $\delta x$ within the ion trap, as taught in some of the prior art noted above, but instead to minimise their velocity spread $\delta v_x$ within the trap at the moment of ejection.

It has been suggested in U.S. Pat. No. 7,897,916 that additional velocity spread may be induced in the ions if upon applying the extraction field the RF trapping field has not stabilised, and that it is important to rapidly terminate the RF trapping field to very low levels in order to minimise this effect. However as already discussed it is difficult practically to suppress the RF trapping field if it is terminated at any time other than when the RF potential is at a zero crossing point.

In a RF quadrupole ion trap containing a buffer gas, where the ions have been thermalized due to collisions with the gas molecules, the ion ensemble is known to oscillate in phase with the RF potential applied to the trap electrodes, for a wide range of m/z. Phase space volume is conserved and when the ions are confined to their minimum extent in one direction they possess their maximum velocity spread in that direction (the ion trajectories are crossing over one another). Conversely, when the ions are at their largest spatial extent in one direction, they possess the minimum velocity spread in that direction. In a linear quadrupole ion trap, when the RF potential on the x rods is at a maximum positive voltage, ions of a positive polarity are at their largest spatial extent in x and at this time the ions possess their minimum velocity spread in x. However whilst this is the most desirable moment at which to eject the ions, to provide the lowest velocity spread in the x direction, the RF potentials applied to the rods are at that moment at a maximum, which may be several thousand volts, and as already described, it is difficult practically to terminate rapidly the potentials on the rod electrodes when the voltages are at a maximum due to the capacitance of the trap electrodes.

European Patent 1302973 describes a 3D quadrupole ion trap in combination with an orthogonal ejector and a TOF mass spectrometer. Ions are ejected from the quadrupole ion trap which contains a buffer gas (sometimes called a collision gas) to cool the ions by multiple collisions, and the ions travel into a region of higher vacuum for subsequent orthogonal acceleration. A high acceleration potential is only applied to the orthogonal ejector, and this reduces the number of high energy collisions between the sample molecular ions and gas molecules, thereby reducing the dissociation of the sample ions. The m/z range of ions admitted to the mass spectrometer is limited by the spread of velocities in the direction of ejection from the trap, and two means for reducing the velocity spread of ions were described: (1) increasing the ejection field within the trap during the time of ejection; (2) varying an electric field in the region between the trap and the orthogonal ejector. Due to the use of an orthogonal extractor, the velocity spread in the direction of ejection from the trap does not affect the mass resolution of the TOF mass spectrometer, rather, the velocity spread in the direction of the time of flight in the spectrometer is a limiting factor. No means for limiting this were described.

U.S. Pat. No. 7,897,916 describes a linear quadrupole ion trap with orthogonal ejection of ions through a slit in one of the rod electrodes to a TOF mass analyser. In one embodiment the trap is interfaced directly to the TOF mass analyser; in another embodiment the trap supplies ions to an orthogonal ejector which sends ions into the TOF mass analyser. The ion trap is driven with a so-called "digital drive" in which the potentials applied to the electrodes are not sinusoidal, but are rapidly switched DC potentials, switched between negative and positive values with equal time for each value providing a square wave drive with 50% duty cycle. Immediately prior to ejection the time period of the switched square wave is increased and an extraction pulse is then applied shortly after. The trapping potentials may be arranged so that one phase is applied to one pair of opposing rod electrodes and the opposing phase is supplied to the other pair of opposing rod electrodes, or alternatively only one phase may be employed, connected to only one pair of opposing rod electrodes and the other pair of opposing rod electrodes are at 0V until an extraction pulse is applied to them. In the latter case, the switched trapping potential is continuously applied to the pair of rod electrodes during the ejection phase, only the switching time period is increased prior to ejection. Ejection of ions was matched to the phase for which the energy spread of ions in a desired direction was at a minimum. The desired direction was varied depending upon the embodiment: where ions were ejected directly from the trap to the TOF mass spectrometer, the desired direction was in the direction of ejection from the trap, as this was the direction of time-of-flight in the TOF mass spectrometer; where the ions were ejected from the trap to an orthogonal ejector the desired direction was orthogonal to the direction of ejection from the trap, to generally be aligned with the direction of time-of-flight in the TOF mass spectrometer. Due to the use of stepped DC trapping potentials, the electric field within the quadrupole ion trap was constant during the period of ion ejection, albeit at a high amplitude. However use of a square or rectangular waveform has practical difficulties, since it necessarily involves abrupt switching of large voltages very rapidly. Practical realization of this approach is difficult because any abrupt switching of the RF voltage involves re-charging of the capacitance formed by the trap's electrodes. Unlike the case of sinusoidal waveform in an RF tank, the electric energy stored in the capacitance in not recuperated by a magnetic coil but must be dissipated. Voltage 'ringing' also is very difficult to avoid.

In view of the above, the present invention has been made.

SUMMARY OF THE INVENTION

According to an aspect of the present invention there is provided a method of ejecting ions to be analysed from a quadrupole ion trap in which a trapping field is created by one or more RF voltages applied to one or more electrodes of the trap, the method comprising, the steps of: (a) cooling the ions to be analysed within the quadrupole ion trap until the ions are thermalized; (b) reducing the amplitude of one or more RF voltages applied to the quadrupole ion trap and applying the one or more reduced amplitude RF voltages for substantially one half cycle from where the one or more RF voltages have reached a zero crossing point; (c) turning off the RF voltages applied to the quadrupole ion trap after the one half cycle; steps (a) to (c) being performed in that order; and (d) ejecting the ions to be analysed from the quadrupole ion trap concurrently with or after step (c).

According to another independent aspect of the invention there is provided an ion ejector system for a mass analyser comprising a quadrupole ion trap for containing a buffer gas; a RF power supply with one or more outputs electrically connected to one or more electrodes of the quadrupole ion trap; an ejection power supply with one or more outputs electrically connected to one or more electrodes of the quadrupole ion trap; and a controller electrically connected to the RF power supply and the ejection power supply, the controller arranged to: (a) control the RF power supply to supply one or more RF voltages at a first amplitude to one or more electrodes of the ion trap for a first period of time, wherein the first period of time is sufficient for ions within the quadrupole ion trap to become thermalized due to collisions with the buffer gas; (b) control the RF power supply after the first period of time to supply one or more RF voltages of a second amplitude to one or more electrodes of the quadrupole ion trap for substantially one half cycle from where the one or more RF voltages have reached a zero crossing point, the second amplitude being smaller than the first amplitude; (c) control the RF power supply to turn off the RF voltages applied to the quadrupole ion trap after the one half cycle; the controller being arranged to perform (a) to (c) in that order; and (d) control the ejection power supply to supply one or more ejection voltages to the quadrupole ion trap concurrently with or after turning off the RF voltages applied to the quadrupole ion trap in (c).

It is desirable to eject ions from the quadrupole ion trap in a way which minimises the velocity spread in a preferred direction. The preferred direction may be generally in the direction of an analyser injection trajectory in embodiments in which the quadrupole ion trap ejects ions directly into the analyser. Alternatively the preferred direction may be substantially orthogonal to the analyser injection trajectory in embodiments in which the quadrupole ion trap ejects ions into an orthogonal ejector, and ions are ejected from the orthogonal ejector into the mass analyser. As will be appreciated, ions may be deflected through an angle after they leave the quadrupole ion trap so that they then enter an analyser along an injection trajectory, or so that they enter an orthogonal ejector, in which case the preferred direction may be inclined at an angle to the injection trajectory or inclined at an angle to the orthogonal of the injection trajectory respectively.

However, as has been described above, thermalized ions within a quadrupole ion trap possess a minimum velocity spread when the one or more applied RF trapping potentials are at a maximum amplitude, i.e. when the one or more RF trapping potentials are not at a zero crossing point. The maximum amplitude of the RF trapping potentials may be thousands of volts and as noted above it is impractical to reduce these potentials to near zero within a very short timescale (i.e. much less than one RF cycle) due to the capacitance of the trap electrodes and associated electronic circuitry. The present invention overcomes these limitations.

The ions are cooled until thermalized within the quadrupole ion trap by collisions with a buffer gas which is introduced into the quadrupole ion trap, the ions losing energy to gas through collisional processes until the ions are cooled to approximately the gas temperature. At a gas pressure of between $10^{-4}$-$10^{-2}$ mBar the time to achieve thermalization is between $10^{4}$-$10^{2}$ RF cycles of the RF power supply, also depending upon the mass of the ions and the mass of the gas. Upon thermalization the ions acquire an average kinetic energy SE close to 1.5 $k_bT$ where T is the buffer gas temperature and $k_b$ is the Boltzmann constant. Under conditions of thermalization in a RF quadrupole trap, the ion ensemble is known to oscillate in phase with the RF voltage. When the RF voltage is at maximum amplitude, the instantaneous spatial spread $\delta x$ reaches its maximal or minimal value depending on the polarity of the applied voltages and the polarity of the ions. Accordingly, the velocity spread $\delta v$ takes two different values, keeping the product $\delta x \delta v$ constant in accordance with the phase volume conservation law. In order to avoid the aforementioned difficulties in terminating the RF trapping potentials when at their maximum amplitude, the RF trapping potentials can be terminated at a zero crossing point. However, the ions within the ion ensemble possess increased velocity spreads at the zero crossing points, the extra velocity spread being associated with transition from the minimum $\delta x$ to the maximum $\delta x$ or in the opposite direction. In the zero crossing points, the average energy of the ions exceeds the thermal energy by a factor of three (for high m/z) or even more (for lower m/z).

According to the present invention, the amplitude of the one or more RF trapping potentials is reduced for one half cycle after a zero crossing point, i.e. from where the one or more RF trapping potentials crosses a zero point. After this half cycle, preferably substantially immediately after this half cycle, when the one or more RF trapping potentials reach the next zero crossing point, these potentials are turned off. Surprisingly the reduction in amplitude of the RF trapping potentials for one half cycle causes the ion trajectories to be modified within the quadrupole ion trap so that after the half cycle the ions possess a minimum in their velocity spread. The method of the present invention slows down the changes of velocity during the said half cycle and thus effectively shifts the time at which the ion ensemble acquires the minimum velocity spread towards a later moment of time which coincides with the next zero crossing point. The minimum velocity spread is achieved when the one or more RF trapping potentials are at the next zero crossing point and can readily be terminated and an extraction field can be applied. In some embodiments the extraction field may be applied shortly before the RF trapping potentials have reached the zero crossing point as long as the extracted ions leave the trap after the RF trapping potentials have reached the zero crossing point. Due to the RF voltage amplitude reduction for one half cycle, the Q-parameter of the Mathieu stability equation within the trap is reduced for a period of time, and the evolution of the ion spread becomes slower. As a result, the maximum spatial spread and the minimal velocity spread are reached later. It is important that a new thermal equilibrium for the modified Q-parameter is not achieved during the half cycle time period, and this is achieved because a sufficient number of collisions do not occur during this time, for the gas pressure utilized in the trap. The smaller phase volume typical of higher values of Q is practically conserved during the half cycle time period until extraction.

By choosing the zero crossing point to initiate the reduction in RF amplitude, the ions extracted possess a minimum velocity spread in a preferred direction and the preferred direction (x or y) may be chosen. A mixture of ions with different m/z ratios is normally present in an RF ion trap and all are extracted simultaneously. Advantageously, ions of a wide range of m/z retain their minimum velocity spreads almost at the same time, namely when the one or more RF trapping potentials reach the next zero crossing point, one half cycle after the amplitudes of the one or more RF voltages were reduced. This allows reduction of the turn-around time for all types of ion species stored in the RF quadrupole trap, with the Mathieu equation Q-parameter spanning from $Q_{min} \approx 0.01$ to $Q_{max} \approx 0.901$, the minimum value corresponding to the practical minimum of the ponderomotive force and the maximum value corresponding to the low-mass limit of the stability region.

Where the quadrupole ion trap is a linear trap, it preferably comprises four electrodes extended generally parallel to an axis, the four electrodes comprising two opposing pairs of electrodes; a first opposing pair of electrodes having a first RF voltage applied to them and a second opposing pair of electrodes having a second RF voltage applied to them, the first and second RF voltages being of opposite polarities. Where the quadrupole ion trap is a 3D trap it preferably comprises a ring electrode and two end-cap electrodes. For such a 3D trap, three alternative methods of operation may be used. In a first method the ring electrode may have a first RF voltage applied to it and the end cap electrodes have a second RF voltage applied to them, the first and second RF voltages being of opposite polarities. In a second method, the ring electrode may have a first RF voltage applied to it and the end cap electrodes have a steady state voltage applied to them. In a third method the ring electrode has a steady state voltage applied to it and both end caps have a first RF voltage applied to them. The one or more RF voltages applied are preferably voltages which vary in a sinusoidal manner in time. In an alternative embodiment, but of greater practical difficulty, the one or more RF voltages may vary according to any other wave in time, including a square or rectangular wave form.

In the method of the present invention, where two RF voltages are applied to electrodes of the quadrupole ion trap, the step of reducing the amplitude of one or more RF voltages may comprise: (1) reducing the amplitude of both the first and the second RF voltages by a factor d; or (2) reducing the amplitude of only one of the first and the second RF voltages substantially to zero. Thus, the total amplitude of the reduced amplitude one or more RF voltages is non-zero (i.e. the sum of the amplitudes of the one or more RF voltages when reduced is non-zero). Reducing the amplitude of only one of the first and the second RF voltages substantially to zero is equivalent to reducing the amplitude of both the first and the second RF voltages by a factor 0.5 (i.e. d=0.5) because the ion motion is determined by differences of the applied voltages but not the absolute values. Alternatively, in the method of the present invention where two RF voltages are applied to electrodes of the quadrupole ion trap, the step of reducing the amplitude of one or more RF voltages may comprise: (3) changing the amplitude of the first RF voltage by a factor e and changing the amplitude of the second RF voltage by a factor f, the changes to the amplitudes being such that (e+f)/2 is smaller than 1. The quantity $(e+f)/2=d_{effective}$ and changing the amplitude of both the RF voltages in this way is equivalent to reducing the amplitude of both the RF voltages by factor $d_{effective}$. Accordingly, in embodiments where there is provided an ion ejector system for a mass analyser, the controller is arranged to control the RF power supply after the first period of time to supply the first RF voltage at a second amplitude and the second RF voltage at a third amplitude, the second amplitude being a factor e of the first amplitude and the third amplitude being a factor f of the first amplitude, where (e+f)/2 is smaller than 1.

Alternatively, where only one RF voltage is applied to the quadrupole ion trap, the step of reducing the amplitude of one or more RF voltages may comprise reducing the amplitude of the first RF voltage by a factor d. As mentioned above, the total amplitude of the RF voltage would remain non-zero.

Preferably d is within the range 0.3 to 0.7. More preferably d is within the range 0.4 to 0.6. More preferably still, d is within the range 0.45 to 0.55. Preferably (e+f)/2 lies within the range 0.3 to 0.7. More preferably (e+f)/2 lies within the range 0.4 to 0.6. More preferably still (e+f)/2 lies within the range 0.45 to 0.55.

Where the quadrupole ion trap is a linear trap comprising four electrodes extended generally parallel to an axis, the electrodes of the linear ion trap may not be exactly parallel i.e. the trap electrodes may taper or may curve towards each other or away from each other as they extend generally parallel to the axis, (as shown, for example, in WO 2008/081334), and the axis may not follow a straight path, i.e. the trap axis may be curved, (as described in WO 2008/081334 for example). The present invention may be applied to such linear ion traps. As used herein, electrodes extended generally parallel to an axis includes electrodes that taper or curve towards or away from each other as they extend generally parallel to the axis, and/or includes electrodes that extend generally parallel to a curved axis.

It is convenient to operate the quadrupole ion trap at a first steady offset potential relative to ground whilst the trap is being filled with ions, and then change the offset to a second offset potential before ion ejection. All electrodes of the ion trap have the same offset potential applied to them, in this case. In this way the ion trap may operate near or at ground potential during the loading of ions, then the ions contained within the trap may be lifted in potential energy relative to a mass analyser, and then after ejection from the trap the ions accelerate to a kinetic energy suitable for use in the mass analyser. Accordingly step (c) may comprise switching all the trap electrodes to the same potential, and that potential may be several kV from the first offset potential.

Ions to be analysed are ejected from the quadrupole ion trap by applying one or more ejection voltages to electrodes of the trap. Where the quadrupole ion trap is a linear ion trap comprising four electrodes extended generally parallel to an axis, the four electrodes comprising two opposing pairs of electrodes, ejection voltages may be applied to only some or to all four of the electrodes. Where the quadrupole ion trap is a 3D trap comprising a ring electrode and two end-cap electrodes, the ejection voltages may be applied to one or both end cap electrodes. In addition a voltage may be applied to the ring electrode. It may be desirable to apply the one or more ejection voltages after a time delay to ensure that the RF voltages have reached 0V within a given voltage tolerance, i.e. that any overshoot or undershoot of the terminating RF voltage has decayed away to within a predefined voltage tolerance before the one or more ejection voltages are applied. In this case, preferably the one or more ejection voltages are applied after a time delay to ensure the voltages of trap electrodes have settled to a substantially steady state prior to application of the one or more ejection voltages. Preferably the time delay is less than 30% of the period of oscillation of the RF voltages.

In embodiments in which the ions are ejected directly into an analyser, preferably the ions to be analysed are ejected from the quadrupole ion trap in an ejection trajectory and the zero crossing point in step (b) is chosen such that the ions to be analysed have a velocity spread in the ejection direction which is less than the velocity spread in a direction orthogonal to the ejection direction. Preferably the ions ejected from the trap are received by a time-of-flight mass analyser or by an electrostatic trap mass analyser.

In embodiments in which the ions ejected from the trap are received in an orthogonal ejector, preferably the ions to be analysed are ejected from the trap in an ejection direction, the ejection direction being generally orthogonal to an analyser injection trajectory, and the zero crossing point in step (b) is chosen such that the ions to be analysed have a velocity spread in the direction of the analyser injection trajectory which is less than the velocity spread in the ejection direction. Preferably ions to be analysed are then ejected from the orthogonal ejector into a time-of-flight mass analyser or an electrostatic trap mass analyser.

Preferably the mass analyser performs a step of mass analysis to provide information on the number of ions having one or more mass to charge ratios. Preferably the information comprises a mass spectrum.

The present invention may be implemented with a quadrupole ion trap, a RF voltage supply having one or more outputs, an ejection voltage supply having one or more outputs and a controller, the controller arranged or programmed to control the RF voltage supplies and the ejection voltage supplies to follow the method of the invention. The controller may comprise a computer. A further aspect of the invention thus provides a computer program having modules of program code for carrying out the method of the present invention (i.e. when the program is executed on a computer). Apparatus in accordance with the present invention may include an ion ejector system comprising a quadrupole ion trap, a mass analyser and optionally an orthogonal ejector disposed between the quadrupole ion trap and the mass analyser. Other ion optical devices may be placed upstream of the ion ejector system to perform various ion processing steps.

The present invention provides an ion packet comprising ions with lower velocity spreads in a preferred direction immediately prior to ejection. Upon ejection, such an ejected ion packet may enable a higher mass resolving power to be achieved in a subsequent step of mass analysis due to the reduced initial velocity spread. Advantageously, the ions may be ejected from the trap in a process in which one or more RF trapping voltages are terminated when they reach a zero crossing point, overcoming the practical difficulties suffered by prior art arrangements in which it is practically very difficult to terminate rapidly RF trapping voltages when they are at their maximum amplitudes.

Other preferred features and advantages of the invention are set out in the description and in the dependent claims which are appended hereto.

DESCRIPTION OF THE FIGURES

FIG. 2A also includes a schematic figure depicting the orientation of ion ejection and voltages applied for an embodiment of a linear trap.

FIG. 7 shows three different amplitude waveforms superimposed (A, B, C), exemplifying three different trapping conditions able to be generated by the electronic arrangement as examples.

DETAILED DESCRIPTION OF THE INVENTION

Various embodiments of the present invention will now be described by way of the following examples and the accompanying figures.

Figure 1:
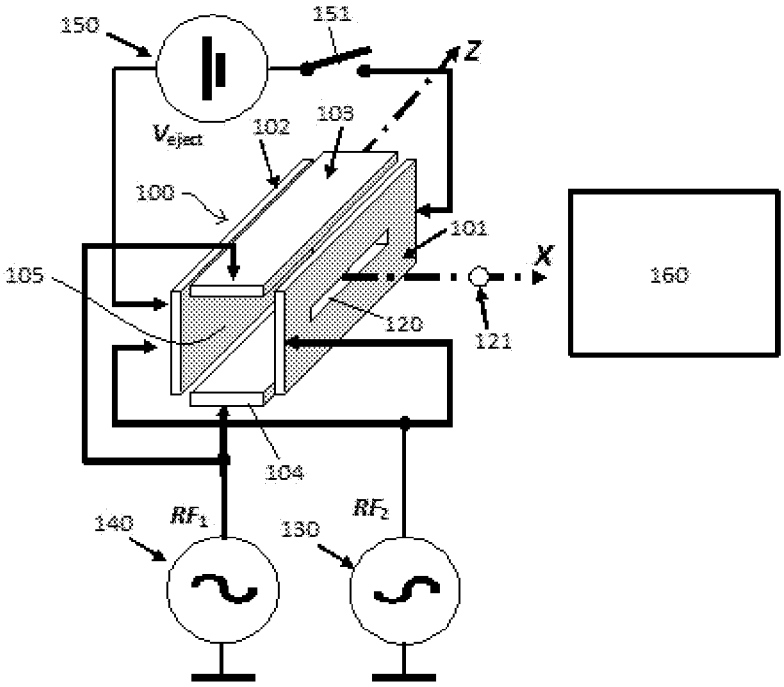
FIG. 1 shows a schematic perspective view of a linear quadrupole ion trap for use with the present invention.

FIG. 1 shows a schematic perspective view of a linear quadrupole ion trap for use with the present invention. The trap 100 comprises four electrodes, 101, 102, 103, 104. Electrodes 101 and 102 oppose one another in the X direction, and electrodes 103, 104 oppose one another in the Y direction. Electrodes 101 and 102 are oriented perpendicular to electrodes 103 and 104. Electrodes 101, 102, 103, 104 are shown as flat plates each having a length oriented parallel to axis Z, but may be round rods each with an axis parallel with axis Z. Alternatively the electrodes may comprise hyperbolic surfaces facing in towards axis Z. Other electrode shapes are contemplated. Electrode 101 has a slot 120 for ejection of ions 121 from the trap 100 in the X direction towards mass spectrometer 160, which may be a TOF mass spectrometer, or a FT mass spectrometer, or an EST mass spectrometer, for example.

The ion trap is filled with a buffer gas, normally nitrogen, helium, or any other chemically inert gas, under the intermediate pressure $10^{-4}$-$10^{-2}$ mBar. During ion accumulation, storage and cooling, the opposite pairs of electrodes 101, 102, and 103, 104, are activated by the radio frequency voltages $RF_1$ and $RF_2$ normally having the same frequency f and amplitude $V_0$ but shifted by 180 degrees in phase relative to each other. Typical the RF amplitude may be 400-1000 V and the frequency 0.5-5 MHz.

In prior art embodiments, at a certain moment of time, the RF generators 130 and 140 are switched off and a rapid bipolar voltage pulse is applied to the electrodes 101 and 102 from a DC voltage generator 150. The ions are accelerated by the electric field in the positive X direction and exit the ion trap through a slit aperture 120 in the electrode 101. In the present invention a different ejection process is utilized.

Electrodes 101, 102 are connected electrically to RF drive circuit 130 which supplies voltage $RF_2$ and also to extraction voltage supply 150 via switch 151. Extraction voltage supply 150 supplies voltage $V_{eject}$ across electrodes 101 and 102 when switch 151 is made conductive. Electrodes 103, 104 are connected electrically to RF drive circuit 140 which supplies voltage $RF_1$. Trap 100 also comprises trapping electrodes at each end of the trap to confine the ions within the trapping volume 105 and prevent them escaping in directions generally along the Z axis, but for clarity these electrodes and their associated voltage supplies are omitted from the figure. Voltages $RF_1$ and $RF_2$ are periodically varying voltages in time (preferably sinusoidally), and are of opposite phases.

In use, the trap 100 has a collision, or buffer, gas admitted within the trapping volume 105 and RF drive circuits 130 and 140 are switched on to provide RF trapping potentials to the trap electrodes 101, 102, 103, 104. Switch 151 is non-conductive so that no extraction voltages are supplied to the trap electrodes 101 and 102. Ions including, in this example, positive ions to be analysed, are admitted to the trapping volume 105 and whilst held within the trap by the trapping field which is created by the trapping potentials, undergo collisions with the buffer gas molecules, losing excess energy. Once the ions have thermalized, i.e. substantially come into thermal equilibrium with the buffer gas under the influence of the trapping field, after a time delay $t_1$ after ions were admitted to the trap, the ejection process may commence.

Figure 2A:
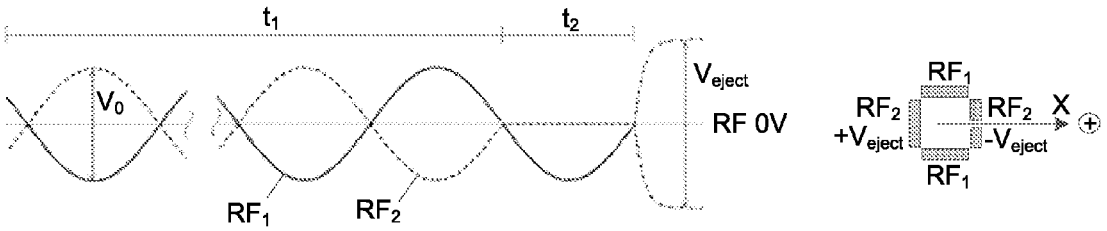
FIGS. 2A-2C show examples of voltage waveforms plotted against time according to the method of the present invention, depicting three different embodiments of the invention suitable for ejecting positive ions from a quadrupole trap having reduced velocity distributions in the direction of ejection.

Referring now also to FIG. 2A, in accordance with a preferred embodiment of the present invention, after time delay $t_1$, just as voltage $RF_2$ supplied by RF drive circuit 130 reaches a zero crossing point and is about to go to a positive voltage, the RF drive circuit 130 is turned off and electrodes 101 and 102 are held at the RF ground potential (RF 0V). RF drive circuit 140 is allowed to continue to operate, voltage $RF_1$ passing from a zero crossing point at time $t_1$ and going negative for a further half cycle during time period $t_2$. After time period $t_2$ has elapsed RF drive circuit 140 is also turned off, again at a zero crossing point, and electrodes 103 and 104 are held at the RF ground potential. At substantially the same time, extraction voltage supply 150 is switched by making switch 151 conductive so as to apply extraction potentials to electrodes 101 and 102. Extraction potentials are in practice developed on electrodes 101 and 102 very shortly after time period $t_2$ has elapsed, preferably within one half RF cycle. Optionally a small delay, $t_3$ (not shown in the figure), may occur between turning off RF drive circuit 140 and turning on extraction voltage supply 150 in order to ensure that the potentials on electrodes 103 and 104 have completely settled, though time period $t_3$ should be less than 30% of one RF cycle. The extraction potential can also be applied shortly before the time period $t_2$ ends, however the bunch of ejected ions must reach the ejection slot 120 after the RF field is completely stopped.

Voltage supply 150 supplies voltage $V_{eject}$ such that electrode 101 has a negative ejection potential applied to it, and electrode 102 has a positive ejection potential applied to it. In this embodiment, electrodes 103 and 104 remain at the RF ground potential during ion ejection. Positive ions to be analysed 121 are ejected from the trap 100 through slot 120, and travel to mass spectrometer 160. In this embodiment ions are ejected directly into an injection trajectory for the mass analyser, and have reduced velocity spreads in the direction of ejection from the ion trap.

Figure 2B:
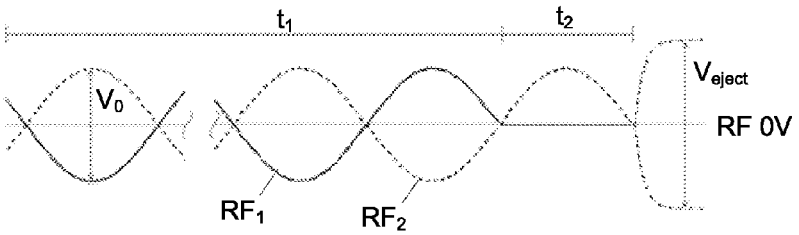

A further embodiment of the invention may be utilised in a similar manner to that just described, but in accordance with FIG. 2B. In this case, after time delay $t_1$, the RF drive circuit 140 is turned off at the zero crossing point and electrodes 103 and 104 are held at the RF ground potential (RF 0V). RF drive circuit 130 is allowed to continue to operate, voltage $RF_2$ passing from a zero crossing point at time $t_1$ and going positive for a further half cycle during time period $t_2$. After time period $t_2$ has elapsed RF drive circuit 130 is also turned off, again at a zero crossing point, and electrodes 101 and 102 are momentarily held at the RF ground potential. At substantially the same time, extraction voltage supply 150 is switched by switch 151 so as to apply extraction potentials to electrodes 101 and 102. Voltage supply 150 supplies voltage $V_{eject}$ such that electrode 101 has a negative ejection potential applied to it, and electrode 102 has a positive ejection potential applied to it. Positive ions to be analysed are ejected from the trap 100 through slot 120, and travel to mass spectrometer 160. In this embodiment ions are ejected directly into an injection trajectory for the mass analyser, and have reduced velocity spreads in the direction of ejection from the ion trap.

Figure 2C:
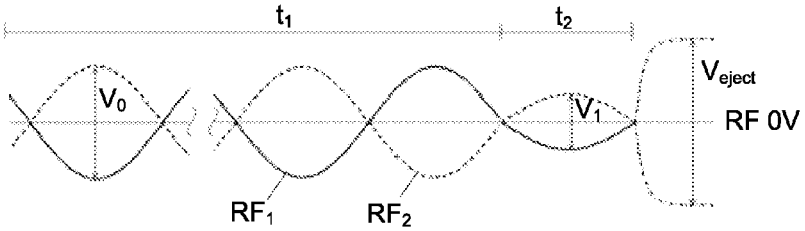

An alternative embodiment of the invention may be utilised in accordance with FIG. 2C. In this case, after time delay $t_1$, from the zero crossing point and for one half cycle thereafter RF drive circuits 130 and 140 provide reduced amplitude RF drive voltages $RF_2$ and $RF_1$ respectively, the peak to peak voltage changing from $V_0$ to $V_1$, where $V_1=d\times V_0$ ($0<d<1$). After a further time period $t_2$ has elapsed, both RF drive circuits are turned off and electrodes 101, 102, 103, 104 are momentarily held at the RF ground potential. At substantially the same time, extraction voltage supply 150 is switched by making switch 151 conductive so as to apply extraction potentials to electrodes 101 and 102. Voltage supply 150 supplies voltage $V_{eject}$ such that, for positive ions to be analysed, electrode 101 has a negative ejection potential applied to it, and electrode 102 has a positive ejection potential applied to it. Ions to be analysed are ejected from the trap 100 through slot 120, and travel to mass spectrometer 160. In this embodiment ions are ejected directly into an analyser injection trajectory, and have reduced velocity spreads in the direction of ejection from the ion trap.

Embodiments described in relation to FIGS. 2A, 2B, and 2C are all arranged to eject ions of a positive polarity so that those ions have a minimum velocity distribution in the direction of ejection. If ions of negative polarity are to be ejected, the polarities of voltages $RF_1$ and $RF_2$ are reversed and upon ejection, electrode 102 has a negative ejection potential applied to it, and electrode 101 has a positive ejection potential applied to it.

The moments after time periods $t_1$ and $t_2$ when the transition process correspondingly starts and ends, as well as the moment when the ejection voltage is applied, are defined with the accuracy up to a fraction of the RF period. Due to the limitation of the electronic circuits providing the RF and the pulsed ejection voltages, the transition from the full RF amplitude to the attenuated RF amplitude, switching the RF off, and the rise of the ejection voltage from zero to $V_{eject}$ take some time, which normally doesn't exceed one RF period. The moments after time periods $t_1$ and $t_2$ are considered herein as the time moments when the said changes start.

Embodiments described in relation to FIGS. 2A and 2B have the additional advantage that they require complete termination of the RF voltages but not changing to lower, non-zero amplitudes. This is easier to implement provided that the two RF generators are individual but synchronized in phase, e.g. activated with one primary transformer coil. The method of fast termination of a RF voltage at the zero crossing point may be implemented in various ways, including those described in U.S. Pat. No. 7,498,571, U.S. Pat. No. 8,030,613, or WO2005/124821, for example.

The present invention may also be used in an arrangement in which an orthogonal ejector is placed between the quadrupole ion trap and the mass spectrometer. In this case ions are ejected from the quadrupole ion trap with lowest velocity spread in a direction generally orthogonal to the ejection direction from the quadrupole ion trap, so that the lowest velocity spread lies in the direction of the analyser injection trajectory. If positive polarity ions are to be ejected but with a minimum velocity distribution orthogonal to the direction of ejection, only the polarities of voltages $RF_1$ and $RF_2$ are reversed.

As described in relation to FIG. 2A, in both the embodiments described in relation to FIGS. 2B and 2C, optionally a small delay, $t_3$ (not shown in the figures), may occur after time delay $t_2$ and before turning on extraction voltage supply 150 in order to ensure that the potentials on electrodes have completely settled, though time period $t_3$ should be much shorter than one RF cycle.

$V_1$ may be selected from the range 0.3 $V_0$ to 0.7 $V_0$ with 0.45 $V_0$ being a particularly preferred value. The inventors have found that the effective temperature of ions in the ejection direction falls below that of the buffer gas when the ions are at their maximum spatial extent in the ejection direction, and that by utilising the present invention ions of approximately this lower effective temperature may be ejected from the quadrupole ion trap.

Figure 3:
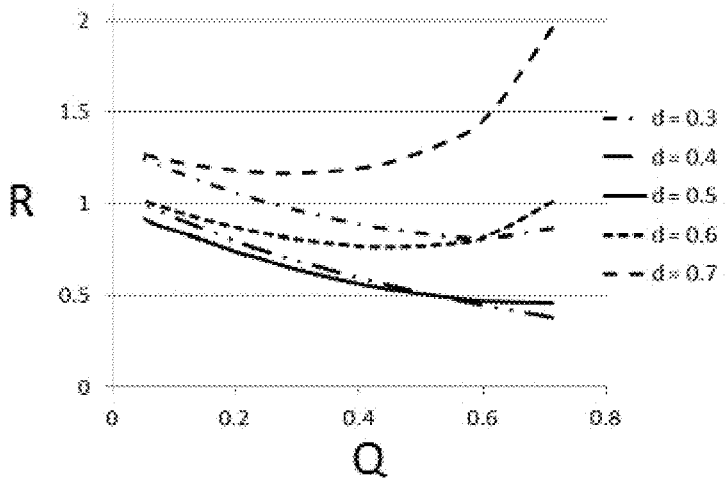
FIG. 3 is a plot of R vs. Q, where R is the ratio of the effective temperature of ions in the ejection direction to the buffer gas temperature, and Q is the Mathieu stability parameter for the quadrupole ion trap. The figure provides data for a range of values d, where $d=V_1/V_0$.

FIG. 3 is a plot of R vs. Q, where R is the ratio of the effective temperature of ions in the preferred direction to the buffer gas temperature, and Q is the Mathieu stability parameter for the quadrupole ion trap. The figure provides data for a range of values d, where $d=V_1/V_0$. It can be seen that the effective temperature of ions in the preferred direction is equal to or below the temperature of the buffer gas for a wide range of stability values, Q, indicating that thermalized ions of a wide range of m/z may be simultaneously ejected from the trap using the present invention. Values for d of 0.4-0.5 produce ejected ions with the lowest effective temperatures. Lowest effective temperatures achieved for these values of d are found at highest values of Q. The effective temperature is defined by the formula $T_{eff}=m\langle v^2\rangle/k_b$ where the angle brackets denote averaging over the ion ensemble and v is the velocity component in the preferred direction. The values of attenuation coefficients in the range $0.3<d<0.6$ correspond to the effective temperature below the temperature of the buffer gas T over a wide range of the Mathieu parameter Q. The optimal attenuation parameter was found to be ~0.45.

Figure 4A:
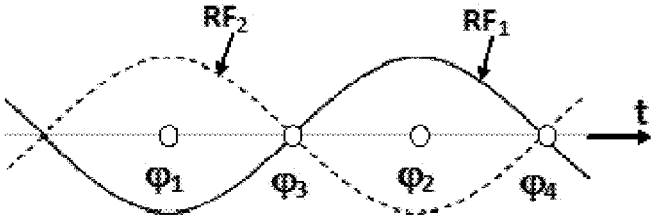
FIG. 4A is a plot of the voltage waveforms vs. time also showing points at particular phases.
Figure 4B:
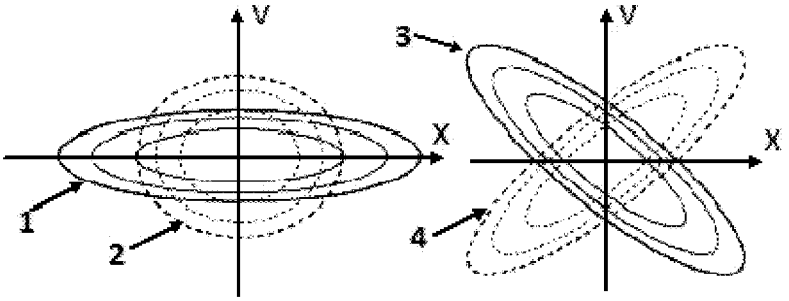
FIG. 4B shows the phase space in X from positively charged thermalized ions within a linear quadrupole ion trap as depicted in FIG. 1 having the voltage waveforms of FIG. 4A applied to the electrodes. The phase space plots of FIG. 4B correspond to the parameters of the ions at the phases noted in FIG. 4A.

FIG. 4A is a plot of the voltage waveforms also showing points at particular phases. FIG. 4B shows the phase space in X from positively charged thermalized ions within a linear quadrupole ion trap as depicted in FIG. 1 having the voltage waveforms of FIG. 4A applied to the electrodes. The phase space plots of FIG. 4B correspond to the parameters of the ions at the phases noted in FIG. 4A. The phase space plots of FIG. 4B illustrate typical phase-volume distributions of an ion ensemble in a RF quadrupole ion trap in the state of dynamic equilibrium with a buffer gas. The solid and dashed lines 1-4 schematically show the level lines of the probability density function in coordinates x and v=dx/dt. The biggest spatial spread (the distribution 1) is attained in the RF phase $\phi=\phi_1$ characterized with the maximal span of RF voltages $RF_1$ and $RF_2$, with the voltage on the electrodes separated in the x direction ($RF_2$ in accordance with FIG. 1) being retarding for the ions, i.e. positive in case of positively charged ions or negative for the negatively charged ions. In the RF phase $\phi_2$ when the polarity of voltages is reversed, the spatial spread attains its minimum as shown by the lines 2. The velocity spread is accordingly bigger than in the phase $\phi_1$. In the intermediate phases $\phi_3$ and $\phi_4$ the RF voltages cross the zero line. These phases correspond to the transition from the biggest spatial spread to the smallest spatial spread ($\phi_3$) and vice versa ($\phi_4$). The ion ensemble is characterized by extra collective velocity as shown by lines 3 and 4, correspondingly.

Table 1 provides values for R, the ratio of the effective temperature of ions to the buffer gas temperature, for different mass ions within the trap (m/z, where z=1), and at different moments of time corresponding to the different phase conditions, $\phi_1$, $\phi_2$, $\phi_3$, $\phi_4$, referred to in relation to FIG. 4. The tabulated values are for a linear quadrupole ion trap having $r_0$=2.2 mm and being operated with $V_0$=800V, f=2.8 MHz.

TABLE 1

| Ion mass m, Da (z = 1) | | 1522 | 254 | 195 |
|---|---|---|---|---|
| Q | | 0.07 | 0.55 | 0.7 |
| R (Effective temperature $T_{eff}/T$) | In the maximum of the RF amplitude span $\phi_1$ | 0.93 | 0.68 | 0.49 |
| | In the maximum of the RF amplitude span $\phi_2$ | 1.1 | 1.7 | 3.0 |
| | In the point of zero-crossing (without the invention) $\phi_3$, $\phi_4$ | 3.0 | 3.6 | 4.3 |
| | In the moment of the second zero-crossing and ejection according to the invention (d = 0.5) | 0.90 | 0.56 | 0.49 |

Table 1 shows that for ions ejected at a zero crossing point ($\phi_3$, $\phi_4$), as in prior art arrangements (i.e. without the benefit of the present invention), the ions possess an effective temperature between 3.0 and 4.3 times larger than the buffer gas temperature. In contrast, when the present invention is utilized, with an attenuation parameter d=0.5, the same ions possess an effective temperature between 0.90 and 0.49 times that of the buffer gas temperature. The present invention thus affords an improvement in effective temperature of a factor 3.3-8.6 depending upon the mass of the ions. The table also shows that with the present invention the ions attain almost the same temperature at a zero-crossing moment as they possessed at $\phi_1$ when the RF voltages were at their maximum amplitude, demonstrating that the reduced RF voltage amplitude for one half cycle causes the ions to retain their minimum temperature.

Figure 5:
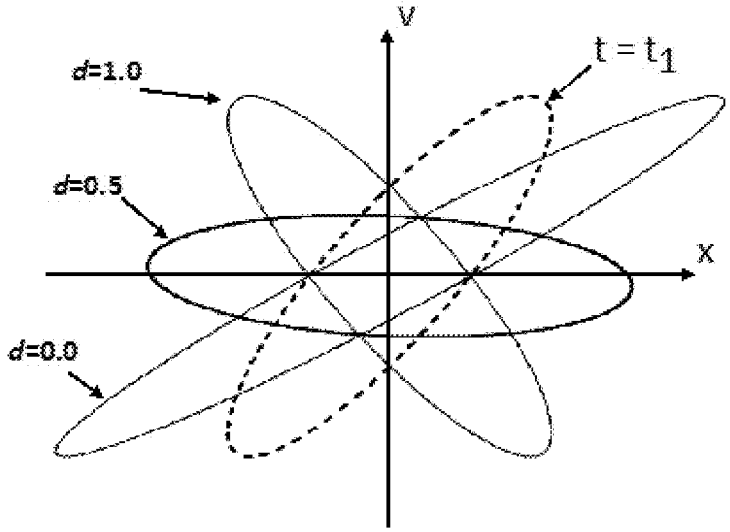
FIG. 5 is a phase space plot in X, showing the level lines of the ion ensemble's phase-space density function in the moment after time period $t_1$ when the transition process starts (dashed ellipse) and after the further time period $t_2$ one half an RF period later (solid ellipses).

FIG. 5 shows the level lines of the ion ensemble's phase-space density function in the moment $t_1$ when the transition process starts (dashed ellipse) and in the moment $t_2$ one half an RF period later (solid ellipses). In the moment $t_1$, the ions had distribution corresponding to the phase $\phi_4$ as shown in FIG. 4. Evolution of the ion ensemble during the transition process $t_1<t<t_2$ depends on the attenuation parameter value, d. The attenuation parameter value d=0 corresponds to complete stop of the RF voltages in the moment $t_1$, so that the ions experience no electric forces and continue the motion with velocities they had in the moment $t_1$. The opposite case, d=1, corresponds to no attenuation effectively applied, and the phase-space density function turns to coincide with that in the RF phase $\phi_3$ after one half of the period. The intermediate value of the attenuation parameter in accordance with this invention, d=0.5, brings the phase-space density to the state with substantially less velocity spread and small correlation between the spatial coordinate x and the corresponding velocity. As already noted, a preferred range for d is between 0.45 and 0.55.

Figure 6:
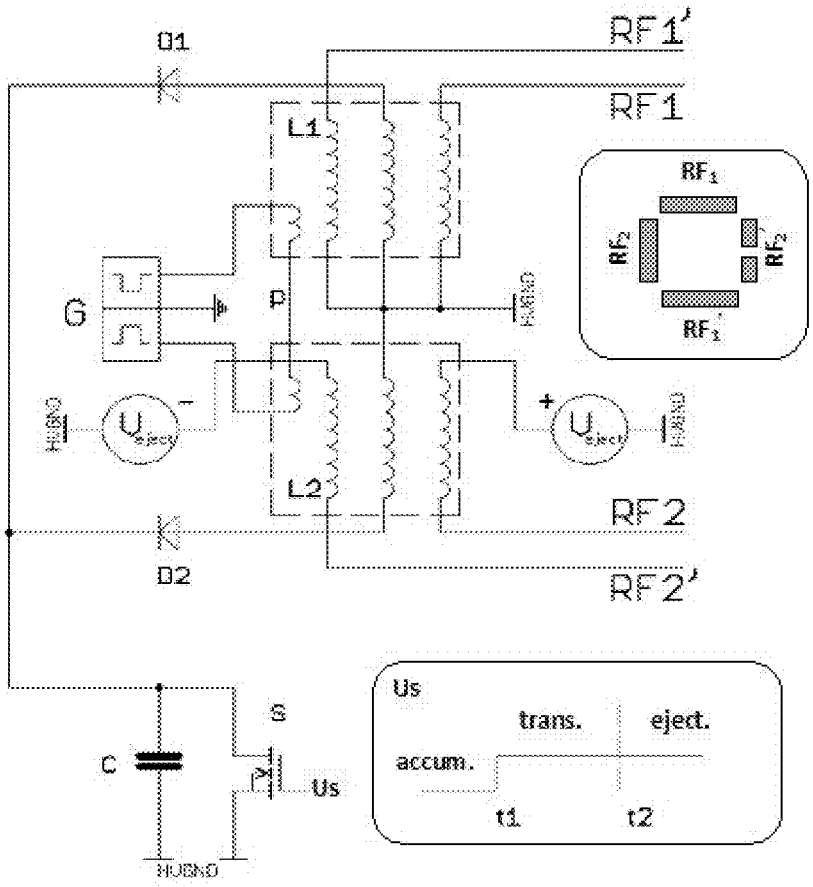
FIG. 6 is a simplified schematic diagram of an electronic arrangement suitable for providing RF trapping voltages and ejection voltages in accordance with an embodiment of the invention. The figure also includes a schematic figure depicting the orientation of a linear trap suitable for use with the electronic arrangement and voltages applied.

FIG. 6 is a simplified schematic diagram of an electronic arrangement suitable for providing RF trapping voltages and ejection voltages in accordance with an embodiment of the invention. A two-fold chopper generator G drives the primary coil P. The set of secondary coils comprises a pair of three-fold coils L1 and L2, which provides the ion trap with both RF polarities, $RF_1$ and $RF_2$, with the 180 degrees phase shift between them. Each of the three-fold coils L1 and L2 is strongly magnetically coupled, but decoupled from the other three-fold coil. The coils L1 and L2 constitute LC tanks together with the capacitances of corresponding trap's electrodes.

Two coils, one from L1 and one from L2, are incorporated with a half-wave rectifier that comprises high-voltage diodes D1 and D2. When at least one of the diodes is forward-biased, a capacitor C is charged periodically to the RF peak voltage. The derived voltage is used to control the output RF amplitude. A high-voltage switch S is connected in parallel with the capacitor C. The switch is implemented with MOSFET transistor(s) and is controlled by a voltage Us, which is kept zero (the switch is non-conductive) during the time period $t_1$ during the ion's accumulation and cooling. After time period $t_1$ has elapsed, which is synchronized with the RF phase as shown in FIG. 2A, the control voltage Us is turned positive and turns the switch S into the conductive mode. The phase $RF_2$ is going positive with respect to the high-voltage ground (HVGND) and the diode D2 allows the three-fold coil L2 to be shortcut, thus suppressing the following positive semi-period of $RF_2$. The other phase $RF_1$ stays negative for another semi-period, so that the diode D1 remains reverse-biased and the switch S has no effect on the coil L1 until the time period $t_2$ has elapsed. The phase of $RF_1$ performs a semi-period swing with its stored energy until the time period $t_2$ has elapsed when the diode D1 becomes forward-biased and shortcuts the coil L1 in its turn. Both RF voltages become zero after time period $t_2$.

Finally, two eject voltage pulse generators $V_{eject}$ apply ejection voltages to the corresponding coils of L2 in opposite polarities, resulting in the voltage difference between $RF_2$ and $RF_2'$ that drives the stored ion out of the trap.

After ejection, the control voltage Us can be switched back to zero thus allowing the RF energy to be accumulated in the LC tanks composed by the coils L1 and L2 and capacitances of corresponding trap' electrodes. The ion trap is then capable of storing ions for another duty-cycle. The schematic solution as described above allows accumulation, cooling, and ejection of positively charged ions. In case of negatively charged ions, the moment $t_1$ when the switch S is turned on (made conductive) should be shifted by one half of RF period and the ejection voltage generators of reversed polarities should be used.

Figure 7:
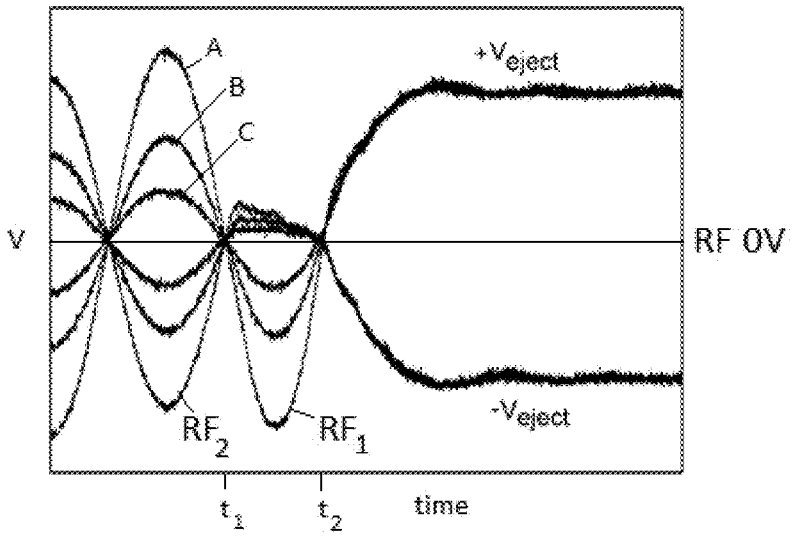
FIG. 7 shows measured output from the electronic arrangement depicted schematically in FIG. 6, being a plot of voltages applied, V, vs. time.

FIG. 7 shows measured output from the electronic arrangement depicted schematically in FIG. 6, being a plot of voltages applied, V, vs. time. FIG. 7 shows three different amplitude waveforms superimposed (A, B, C), exemplifying three different trapping conditions able to be generated by the electronic arrangement as examples. After time period $t_1$, voltage $RF_2$ is terminated to 0V and $RF_1$ continues for one half cycle during a further time period $t_2$. After time period $t_2$ $RF_1$ is terminated and ejection voltages $V_{eject}$ are applied.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

It will also be understood that the present invention is not limited to the specific combinations of features explicitly disclosed, but also any combination of features that are described independently and which the skilled person could implement together.

The invention claimed is:

1. A method of ejecting ions to be analysed from a quadrupole ion trap in which a trapping field is created by one or more RF voltages applied to one or more electrodes of the trap, the method comprising the following steps:

(a) cooling the ions to be analysed within the quadrupole ion trap until the ions are thermalized;

(b) reducing the amplitude of one or more RF voltages applied to the quadrupole ion trap and applying the one or more reduced amplitude RF voltages for substantially one half cycle from where the one or more RF voltages have reached a zero crossing point;

(c) turning off the one or more RF voltages applied to the quadrupole ion trap after the one half cycle; steps (a) to (c) being performed in that order; and (d) ejecting the ions to be analysed from the quadrupole ion trap concurrently with or after step (c).

2. The method of claim 1 wherein the quadrupole ion trap is a linear trap comprising four electrodes extended generally parallel to an axis, the four electrodes comprising two opposing pairs of electrodes; a first opposing pair of electrodes having a first RF voltage applied to them and a second opposing pair of electrodes having a second RF voltage applied to them, the first and second RF voltages being of opposite polarities.

3. The method of claim 1 wherein the quadrupole ion trap is a 3D trap comprising a ring electrode and two end-cap electrodes, the ring electrode having a first RF voltage applied to it and the end cap electrodes having a second RF voltage applied to them, the first and second RF voltages being of opposite polarities.

4. The method of claim 1 wherein the quadrupole ion trap is a 3D trap comprising a ring electrode and two end-cap electrodes, the ring electrode having a first RF voltage applied to it and the end cap electrodes having a steady state voltage applied to them.

5. The method of claim 2 wherein step (b) comprises reducing the amplitude of both the first and the second RF voltages by a factor d.

6. The method of claim 4 wherein step (b) comprises reducing the amplitude of the first RF voltage by a factor d.

7. The method of claim 2 wherein step (b) comprises reducing the amplitude of only one of the first and the second RF voltages substantially to zero.

8. The method of claim 5 wherein d is within the range 0.3 to 0.7.

9. The method of claim 8 wherein d is within the range 0.4 to 0.6.

10. The method of claim 9 wherein d is within the range 0.45 to 0.55.

11. The method of claim 2 wherein step (b) comprises changing the amplitude of the first RF voltage by a factor e and changing the amplitude of the second RF voltage by a factor f, where (e+f)/2 is smaller than 1.

12. The method of claim 11 wherein (e+f)/2 lies within the range 0.3 to 0.7.

13. The method of claim 12 wherein (e+f)/2 lies within the range 0.4 to 0.6.

14. The method of claim 13 wherein (e+f)/2 lies within the range 0.45 to 0.55.

15. The method of claim 1 wherein step (c) comprises switching all the trap electrodes to the same potential.

16. The method of claim 1 wherein step (d) comprises applying one or more ejection voltages onto one or more electrodes of the ion trap.

17. The method of claim 16 wherein the one or more ejection voltages are applied after a time delay from turning off the one or more RF voltages to ensure the voltages of trap electrodes have settled to a substantially steady state prior to application of the one or more ejection voltages.

18. The method of claim 17 wherein the one or more RF voltages applied to the trap vary in time with a period of oscillation and the time delay is less than 30% of the period of oscillation.

19. The method of claim 1 wherein step (a) comprises confining the ions within the trap for a period of time in the presence of a buffer gas, the ions losing energy to gas through collisional processes until the ions are cooled to approximately the gas temperature.

20. The method of claim 1 wherein the ions to be analysed are ejected from the trap in an ejection direction, the ejection direction being generally parallel to an analyser injection trajectory, and the zero crossing point in step (b) is chosen such that the ions to be analysed have a velocity spread in the ejection direction which is less than the velocity spread in a direction orthogonal to the ejection direction.

21. The method of claim 20 wherein ions ejected from the trap are received by a time-of-flight mass analyser or by an electrostatic trap mass analyser.

22. The method of claim 1 wherein the ions to be analysed are ejected from the trap in an ejection direction, the ejection direction being generally orthogonal to an analyser injection trajectory, and the zero crossing point in step (b) is chosen such that the ions to be analysed have a velocity spread in the direction of the analyser injection trajectory which is less than the velocity spread in the ejection direction.

23. The method of claim 22 wherein ions ejected from the trap are received in an orthogonal ejector and are ejected from the orthogonal ejector in the direction of the analyser injection trajectory.

24. The method of claim 23 wherein ions ejected from the orthogonal ejector are received by a time-of-flight mass analyser or by an electrostatic trap mass analyser.

25. The method of claim 21 wherein the ions received by the mass analyser undergo a step of mass analysis to provide information on the number of ions having one or more mass to charge ratios.

26. The method of claim 25 wherein the information comprises a mass spectrum.

27. The method of claim 1 wherein the one or more RF voltages applied to the trap vary in a sinusoidal manner in time.

28. The method of claim 1 wherein the one or more RF voltages applied to the trap vary according to a square wave in time.

29. An ion ejector system for a mass analyser comprising a quadrupole ion trap for containing a buffer gas; a RF power supply with one or more outputs electrically connected to one or more electrodes of the quadrupole ion trap; an ejection power supply with one or more outputs electrically connected to one or more electrodes of the quadrupole ion trap; and a controller electrically connected to the RF power supply and the ejection power supply, the controller arranged to:

(a) control the RF power supply to supply one or more RF voltages at a first amplitude to one or more electrodes of the ion trap for a first period of time, wherein the first period of time is sufficient for ions within the quadrupole ion trap to become thermalized due to collisions with the buffer gas;

(b) control the RF power supply after the first period of time to supply one or more RF voltages of a second amplitude to one or more electrodes of the quadrupole ion trap for substantially one half cycle from where the one or more RF voltages have reached a zero crossing point, the second amplitude being smaller than the first amplitude;

(c) control the RF power supply to turn off the RF voltages applied to the quadrupole ion trap after the one half cycle; the controller being arranged to perform (a) to (c) in that order; and (d) control the ejection power supply to supply one or more ejection voltages to the quadrupole ion trap concurrently with or after (c).

30. The ion ejector system of claim 29 wherein the buffer gas is at a pressure of between $10^{-5}$-$10^{-2}$ mBar and the first period of time is between $10^{4}$-$10^{2}$ RF cycles of the RF power supply.

* * * * *